US005810475A

United States Patent [19]

St. Ama

[11] Patent Number: 5,810,475

[45] Date of Patent: Sep. 22, 1998

[54] SINGLE DISCHARGE DOOR FOR CONTINUOUS OR BATCHING OPERATION OF TWIN-SHAFT TWIN-TROUGH MIXERS

[75] Inventor: Bobby St. Ama, Brownwood, Tex.

[73] Assignee: Brownwood Ross Company, Inc., Brownwood, Tex.

[21] Appl. No.: 714,570

[22] Filed: Sep. 16, 1996

[51] Int. Cl.[6] ..... B01F 15/02; B65D 47/00

[52] U.S. Cl. ..... 366/192; 222/556; 406/129; 406/131

[58] Field of Search ..... 366/77, 84, 184, 366/189, 192, 193, 196, 194, 195, 291; 406/128, 129, 131, 130; 251/298, 300, 301, 302; 222/556, 312, 311, 316, 317; 105/280

[56] References Cited

U.S. PATENT DOCUMENTS

| | | | |
|---|---|---|---|
| 2,164,618 | 7/1939 | Masters | 366/192 |
| 2,861,787 | 11/1958 | Csanyi | 259/153 |
| 3,357,748 | 12/1967 | Lenhart | 406/129 |
| 3,876,261 | 4/1975 | Jucius, Jr. et al. | 406/129 |
| 4,053,088 | 10/1977 | Grataloup | 222/312 |
| 4,411,560 | 10/1983 | McComb | 406/128 |
| 4,473,175 | 9/1984 | Zengaffinen et al. | 222/556 |
| 4,500,230 | 2/1985 | Bateson | 222/556 |
| 4,572,674 | 2/1986 | Mathis et al. | 366/192 |
| 4,775,239 | 10/1988 | Martinek et al. | 366/2 |
| 5,188,264 | 2/1993 | Parkkow et al. | 406/128 |

FOREIGN PATENT DOCUMENTS

| | | | |
|---|---|---|---|
| 17946 | 4/1982 | Japan | 366/192 |

*Primary Examiner*—Tony G. SooHoo

*Attorney, Agent, or Firm*—Crutsinger & Booth

[57] ABSTRACT

A gate for twin shaft mixer having a partial cylindrical body having a longitudinal axis, first and second outer wall portions, and first and second end walls. The first outer wall portion extends between the first and second end walls parallel to the longitudinal axis forming a first working surface. The second outer wall portion extends from the first end wall parallel to the longitudinal axis to a terminal end spaced apart from the second end wall, forming a continuous discharge passage in the partial cylindrical body between the terminal end and the second end wall. The first and second end walls are provided with shafts which extend along a common axis parallel to the longitudinal axis of the cylindrical body, defining an axis of rotation for the gate. A pair of actuator assemblies are provided that support the discharge gate below the discharge opening of a mixer and impart rotation to the gate through the first and second shafts. Each actuator assembly comprises a semicircular rocker and a pair of cylinders. Extension and retraction of the rods of the cylinders rotate the rocker and arm and the gate between a closed position wherein the first working surface blocks the discharge opening of the mixer, a batch discharge position wherein the outer wall portions of the cylindrical body are out of alignment with the discharge opening, and a continuous discharge position wherein the continuous discharge passage is aligned with the discharge opening of the mixer.

11 Claims, 5 Drawing Sheets

SINGLE DISCHARGE DOOR FOR CONTINUOUS OR BATCHING OPERATION OF TWIN-SHAFT TWIN-TROUGH MIXERS

FIELD OF THE INVENTION

This invention relates to a twin-shaft, twin trough mixer. More particularly, this invention relates to a discharge door of a twin-shaft, twin-trough mixer for continuous or batching operation.

BACKGROUND OF THE INVENTION

Mixers have many industrial applications, for example mixing liquid or dry materials for construction, environmental projects, and chemical production. For instance, in the construction field, mixers are used for mixing concrete, base stabilization materials, hot and cold bitumen mixtures for road and athletic grounds, and materials in the sand-lime brick industry. In environmental projects, mixers are used to mix soils or sludges with chemicals to reduce toxicity. Mixers can also be used in waste material remediation processes and in other large scale chemical mixing processes involving slurry and dry powder mixtures.

Apparatus for mixing batches or charges of flowable solid materials, such as constituents of concrete are generally referred to as batch type mixers. U.S. Pat. No. 4,572,674 discloses a batch type mixer having a hollow cylindrical housing with two upright end walls and a hollow shell between the end walls. The lower part of the shell has a large material evacuating opening sealed by two symmetrical doors which are pivotable about horizontal axes. The evacuating opening extends all the way between the end walls and is large enough to allow for gravitational outflow of the entire contents of the housing irrespective of the angle of repose of the charge. Mixing is accomplished by paddles, vanes, blades or other configured mixing instrumentalities mounted on a horizontally disposed shaft extending through the mixing chamber in the shell.

A mixer of the type disclosed in U.S. Pat. No. 4,775,239, entitle "DOUBLE SHAFTFORCED-FEED MIXER FOR CONTINUOUS AND DISCONTINUOUS MANNER OF OPERATION", which has recently proven itself to be superior in several respects when mixing these materials, is the twin-shaft, twin trough mixer, designed to run in either continuous or batching modes of operation. The mixing chamber comprises a pair of cylindrical troughs that are proportioned to form an approximately cubic mixing chamber. An axial shaft with radially extending arms extends through each trough and is supported in the end walls of the troughs. The end of each arm is provided with a paddle for clearing and pushing the mixed material from one end of the chamber to the other end. The shafts are power driven and generally driven in opposite directions so that the material in the mixing chamber moves in a circulating path with continuous exchange of material between the two troughs. An opening and symmetrical wing-like door are provided in the bottom wall of the chamber for discharging the mixed material from the chamber.

A batch type mixer having a casing which provides two spaced troughs and laterally spaced-apart shafts with mixing arms mounted in the mixing chamber. After the batch of material has been mixed, the mixture is discharged from the mixing chamber by opening sliding doors in the bottom of the mixing chamber.

Previously such mixers have been constructed for batch operation, wherein the entire contents of the material is discharged over a short period of time. In such operations, a charge of material is delivered to the mixing chamber, the charge being made up of selected proportions of the materials to be mixed. Once the desired degree of blending has been achieved, the discharge door in the bottom wall of the mixer is opened and the mixed material leaves the mixer through the door under the influence of gravity.

The most efficient batch mode twin-shaft mixers use a discharge door that extends the full length of the chamber along the bottom wall at the line of intersection between the two troughs. The discharge door extends from one end of the mixing chamber to the other end.

A drawback of this type of mixer lies in its batch mode of operation. Although such mixers quickly produce homogeneous mixtures and are well suited for small projects, batch mode mixers are not suitable for projects requiring a large volume of mixed material in a short time. The higher production rates of mixed or treated materials cannot be efficiently produced in the batching mode of operation.

For this reason, mixers of the twin-shaft, twin trough type have been adapted for continuous operation, thus making them capable of continually accepting the materials to be mixed, mixing the materials to the desired degree of homogeneity, and continuously delivering the mixed materials to transport vehicles, or a conveyor system for transport to a point of use.

The continuous discharge twin-shaft, twin-trough mixer includes an inlet apparatus for continuously proportioning and introducing materials into the mixer. The inlet apparatus is typically positioned at the top of the mixer near one end of its mixing troughs. Conventional continuous discharge mixers include one of two basic discharge door arrangements. One design provides the mixer with a single small discharge door, located at the end opposite the end at which the materials are introduced. This design is suitable only for continuous operation. The second design provides the mixer with two separate discharge doors. The first, smaller door is the continuous discharge door, optimized for continuous discharge of the mixer, and is located at the end opposite the end at which the materials are introduced. A second, larger door extends from the end of the mixer at which materials are introduced to the edge of the continuous discharge door. This door allows the mixer to discharge a batch of the mixed materials.

The single continuous discharge door design is limited to a continuous mode of operation and cannot be used to mix discrete batches of materials. In the two door designs, the batch discharge rate through the shorter batch discharge door is slower than the discharge rate through the full length batch discharge door used on mixers dedicated to batch mode operation. Furthermore, as the door does not extend the full length of the mixing chamber, it is difficult to completely discharge all of the mixed material in the mixing troughs. Moreover, there is an area over the continuous discharge door where no mixing action occurs when operating in the batch mode. When the mixer is discharged, some of this unmixed material will be discharged along with the mixed material, contaminating a portion of the properly mixed material.

Accordingly, there is a need for a mixer that can efficiently operate in both batch and continuous modes without sacrificing the batch mode discharge rate. At the same time, there is a need for a mixer that offers an adjustable continuous discharge rate.

SUMMARY OF THE INVENTION

A twin-shaft, twin-trough mixer is disclosed which comprises a mixing chamber and a pair of parallel mixing mechanisms. The chamber preferably comprises a pair of adjacent cylindrical-shaped troughs with spaced apart end walls and a common longitudinal extent. The troughs are joined to form an approximately cubic mixing chamber with a bottom wall defined at the line of intersection between the two troughs along the longitudinal extent. Materials are introduced into the chamber through an inlet provided in a top portion of the chamber. Once mixed, the material is discharge through a discharge opening provided in the bottom wall of the chamber. The manner of discharge through the discharge opening is controlled by a single discharge door.

Each mixing mechanism comprises an axial shaft having a plurality of radially extending arms. The shafts are journaled in end walls of the cylindrical troughs and are driven in opposite directions so that the material in the chamber moves from one end of the chamber to the other end of the chamber in a circulating movement with a simultaneous exchange of mixed material between the two mixing mechanisms. To assure thorough mixing of the material, each arm includes a mixing paddle at its distal end that lifts, clears and pushes the material through the chamber.

In the twin-shaft, twin trough mixer, the mixing process is completed continuously in the longitudinal direction of the mixing trough on the path between inlet and outlet discharge openings. The orientation of the mixing paddles on the two shafts is such that the mixing mechanisms deliver the mixed material in the same direction, from the inlet to the outlet opening.

The discharge opening preferably extends substantially the full longitudinal extent of the bottom wall of the chamber, thus permitting the entire contents of the mixer to be discharged. The discharge door which controls the discharge of the mixed material is pivotally supported below the bottom wall of the chamber by a discharge door support assembly so that it can be rotated to selectively open or close the discharge opening.

The discharge door comprises a segment-shaped partial cylindrical member having spaced apart end walls and a partial cylindrical wall extending between the two end walls to define a working surface. The partial cylindrical wall includes an opening which defines a continuous discharge passage. The discharge door end walls each include an outwardly extending shaft about which the discharge door is pivoted to move the door to one of three general positions.

In the first position, the working surface is aligned with the discharge opening and blocks the opening so that no material is discharged. In the second position, the discharge opening is fully open where the entire working surface of the door is out of alignment with the discharge opening of the mixing chamber. In this fully open position, the mixer operates in a batch mode—the entire contents of the mixer is discharged. In the third position, the working surface is rotated so that the continuous discharge passage of the working surface is aligned with the discharge opening of the mixer and the mixer is operating in a continuous discharge mode. In the continuous discharge mode, the mixer discharges its contents but at a flow rate that permits new material to be introduced simultaneously through the inlet, while providing a continuous flow of mixed material through the discharge opening.

The discharge door support assembly comprises an actuator member with a collar and a pair of cylinders. The actuator member is preferably a semi-circular rocker arm, with the collar positioned at the mid-point of the rocker arm between two opposed arms. The cylinders are connected at their rod ends to actuator member arms and connected at their base ends to a support structure provided on the framework of the mixing chamber. The collar is positioned at the actuator's center of rotation and receives one of the discharge door's shafts. The shaft is fixed in the collar so that rotation of the actuator member imparts rotation to the discharge door. In a first preferred embodiment, the discharge door is supported by a pair of discharge door support assemblies, one at end each of the door.

The actuator member imparts rotation to the door through the door shaft as it is rotated about its center of rotation by the extension of the rod of one cylinder and the retraction of the rod of the other cylinder. The cylinders are actuated by a conventional control system.

DESCRIPTION OF THE DRAWINGS

Drawings of a preferred embodiment of the invention are annexed hereto so that the invention may be better and more fully understood, in which.

Numeral references are employed to designate like parts throughout the various figures of the drawing.

DETAILED DESCRIPTION OF THE PREFERRED EMBODIMENTS

Figure 1:
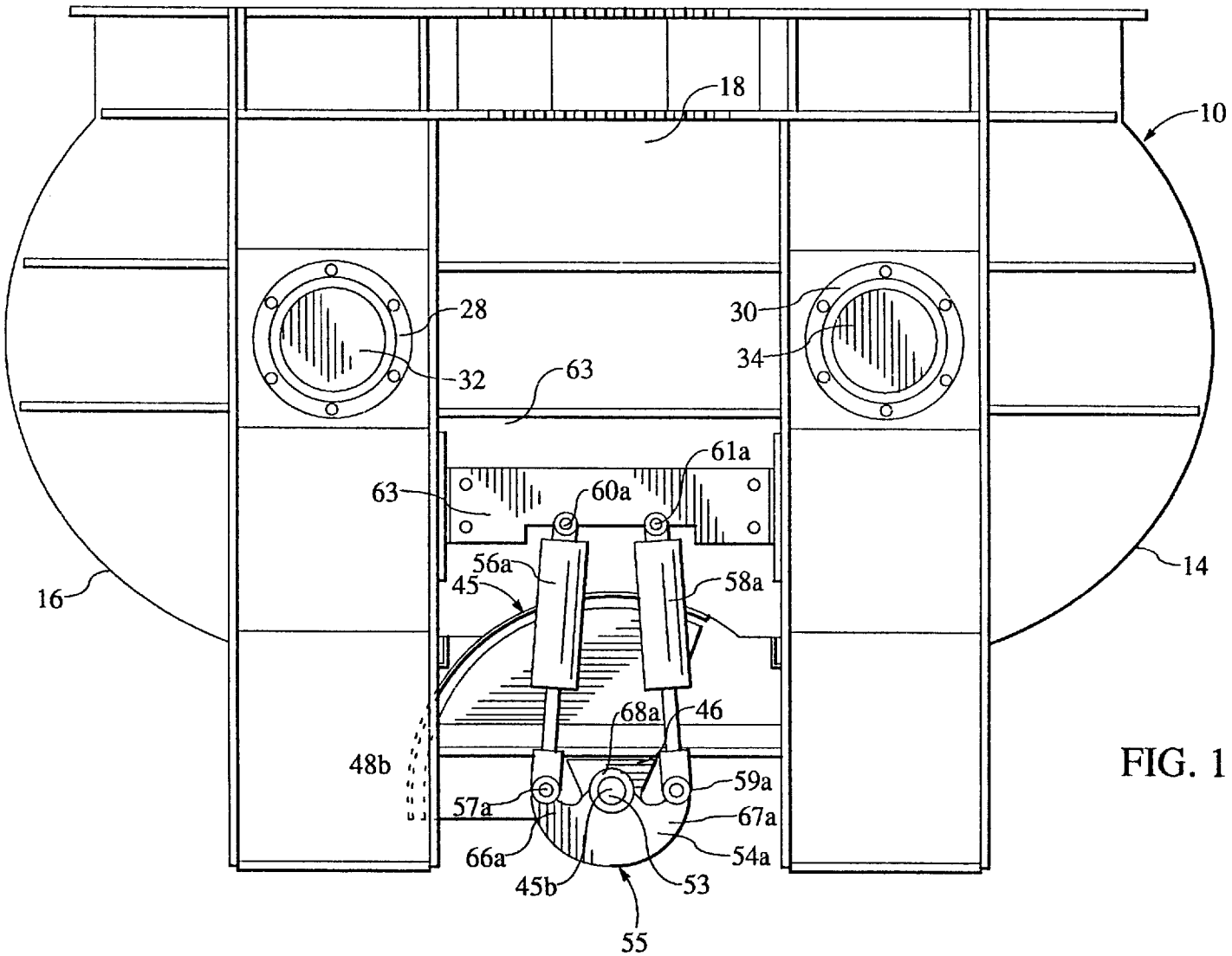
FIG. 1 is a front elevational view illustrating the inlet end of a twin-shaft, twin-trough mixer of the present invention with the discharge door in a closed position.
Figure 2:
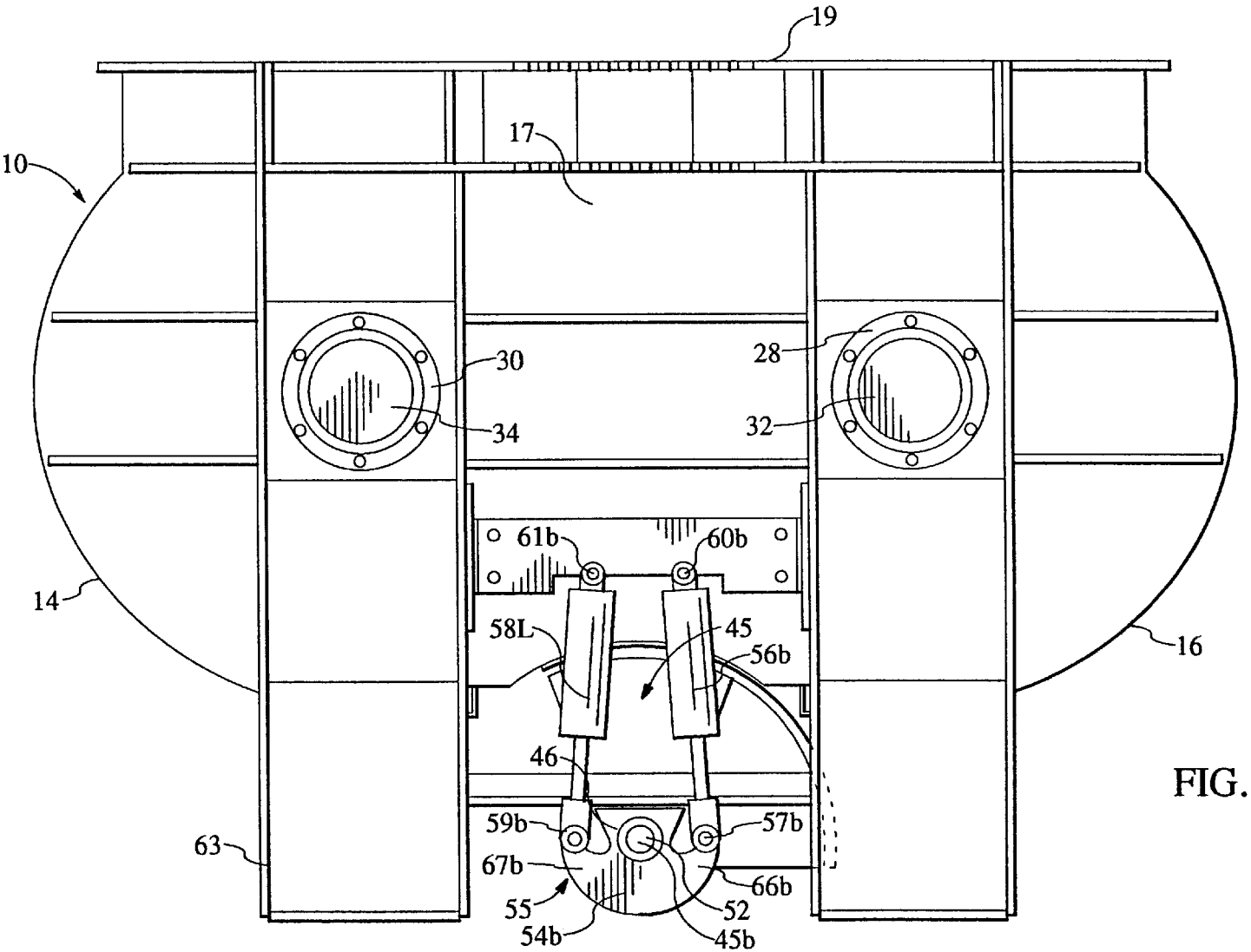
FIG. 2 is a rear elevational view illustrating the discharge end of a twin-shaft, twin-trough mixer with the discharge door in a closed position.
Figure 3:
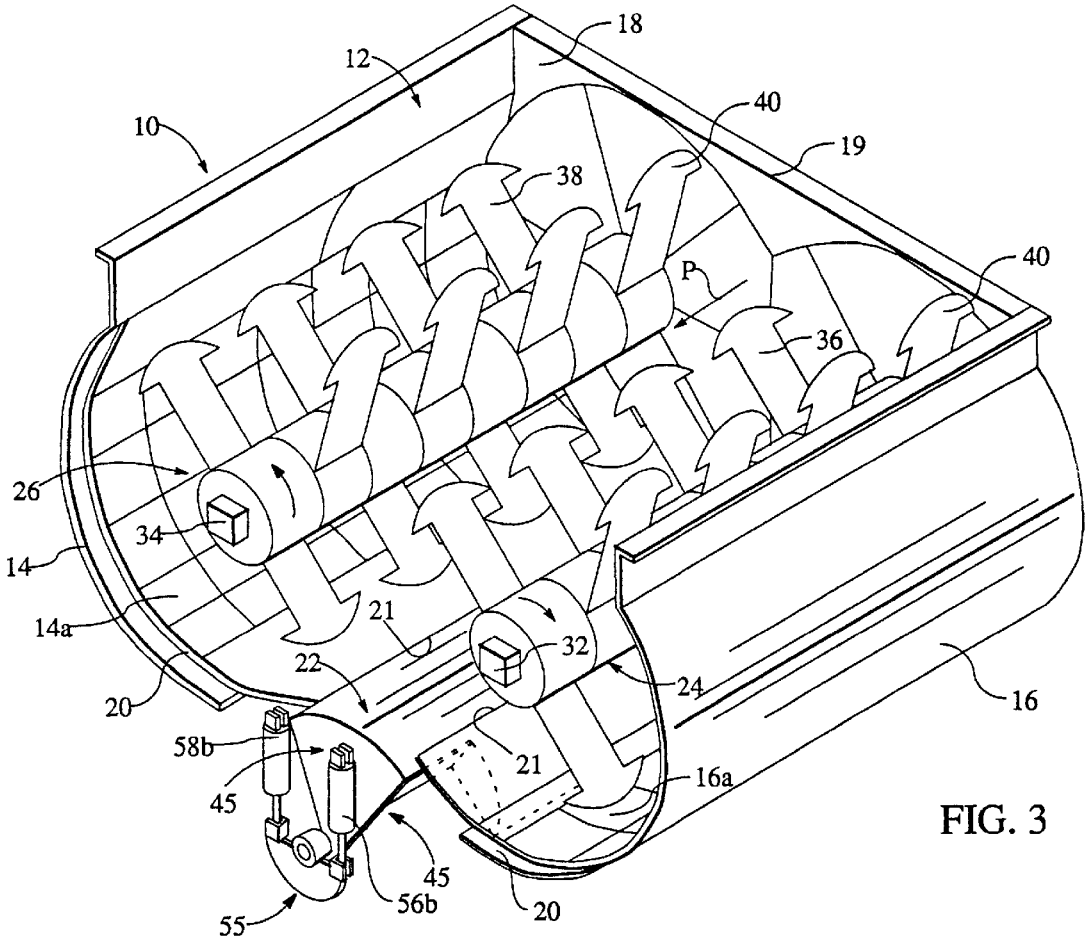
FIG. 3 is a fragmentary perspective view of the twin-shaft, twin-trough mixer of the present invention, the end wall at the discharge end being removed to more clearly illustrate details of construction and illustrating the discharge door in a closed position.

Referring to FIGS. 1, 2 and 3 of the drawing, the numeral 10 generally designates a twin-shaft, twin-trough mixer. The mixer 10 includes a mixing chamber 12 comprised of two cylindrical troughs 14 and 16, each having a longitudinal extent. The troughs 14 and 16 have spaced apart end walls 17 and 18 and are joined to form a mixing chamber with a top end 19 and bottom walls 20. The bottom walls 20 are defined along the line of intersection of the two troughs and along the longitudinal extent between troughs 14 and 16. Mixing chamber 12 includes a discharge opening 22 between adjacent edges 21 of bottom walls 20 for discharging the mixed material from the mixer 10 and an inlet apparatus (not shown) for proportioning and introducing material into mixer 10. The inlet apparatus may include one or more belt or auger conveyors, hoppers or other well-known apparatus for depositing material into mixing chamber 12.

A pair of parallel mixing mechanisms 24 and 26 extend between end walls 17 and 18 of troughs 14 and 16 and are supported in end walls 17 and 18 by bearing assemblies 28 and 30. The mixing mechanisms 24 and 26 each comprise an axial shaft 32 and 34 having a plurality of radially extending arms 36 and 38. The shafts 32 and 34 are driven in opposite directions so that the material in the chamber 12 moves from one end of chamber 12 to the other end of chamber 12 in circulating movement and with a simultaneous exchange of mixed material between two mixing mechanisms 24 and 26. To assure thorough mixing of the material, each arm 36 and 38 includes a mixing paddle 40 at its distal end that clears the material from the inner surfaces 14*a* and 16*a* of the troughs 14 and 16 and pushes the material through chamber 12.

The mixing process is completed continuously in a longitudinal direction in mixing troughs 14 and 16, as denoted by the arrow labeled "P," on the path between the inlet apparatus (not shown) and discharge opening 22. The orientation of mixing paddles 40 on shafts 32 and 34 is such that both mixing mechanisms 24 and 26 deliver the mixed material in the same direction toward the discharge opening 22.

The discharge opening 22 is preferably rectangular and extends the full longitudinal extent of bottom walls 20 of chamber 12 so that the entire contents of mixer 10 can be quickly and easily discharged through discharge opening 22. The discharge of the mixed material through discharge opening 22 is controlled by a discharge gate or door 45, which is pivotally supported below bottom walls 20 of chamber 12 on a discharge door support assembly 46.

The mixer 10 may assume other and further configurations and forms no part of the present invention except in combination with a discharge gate and actuator of the type which will be hereinafter more fully described. The disclosure of U.S. Pat. No. 4,775,239, entitle "DOUBLE SHAFT FORCED-FEED MIXER FOR CONTINUOUS AND DISCONTINUOUS MANNER OF OPERATION," is incorporated herein by reference for a more detailed description of a suitable mixing apparatus.

As will be hereinafter more fully explained, mixer 10 has at least two mixing troughs 14 and 16, formed with curved bottom walls 20 spaced apart to provide a discharge opening 22 between adjacent edges 21 of the curved bottom walls 20 such that mixed material is discharged from the mixer by controlling flow of material through the discharge opening 22.

Figure 3B:
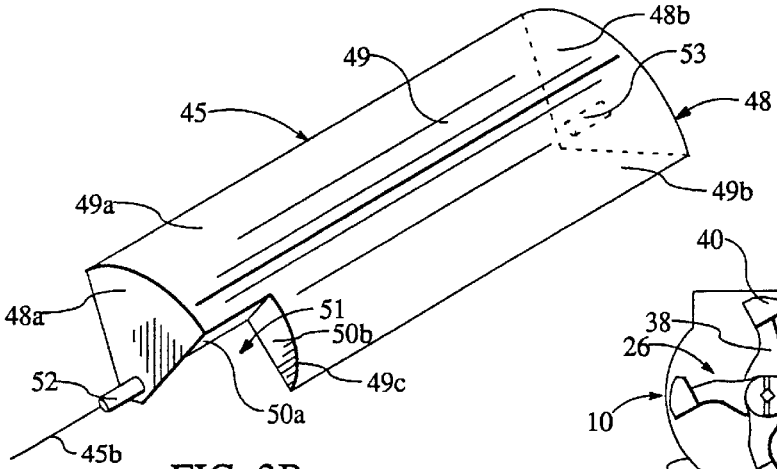
FIG. 3B is a perspective view of the discharge gate in a closed position.
Figure 3A:
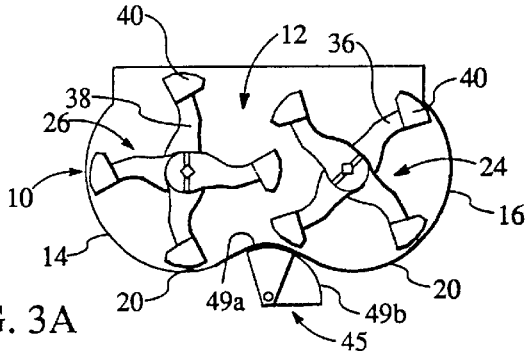
FIG. 3A is a cross-sectional view illustrating the discharge door in a closed position.

As will be hereinafter more fully described, a gate 45 is formed by an elongated curved body 48, best illustrated in FIG. 3B, having first and second ends. The elongated curved body has first and second juxtaposed working surfaces 49*a* and 49*b* configured to selectively move in sealing relation to the curved bottom walls 20 of the troughs 14 and 16 for controlling flow of material through the discharge opening 22. The first working surface 49*a*, extending between said first and second ends of the elongated curved body, is movable into sealing relation with the curved bottom walls 20 to close the discharge opening, as best illustrated in FIGS. 1, 3, 3A and 3B.

Figure 5:
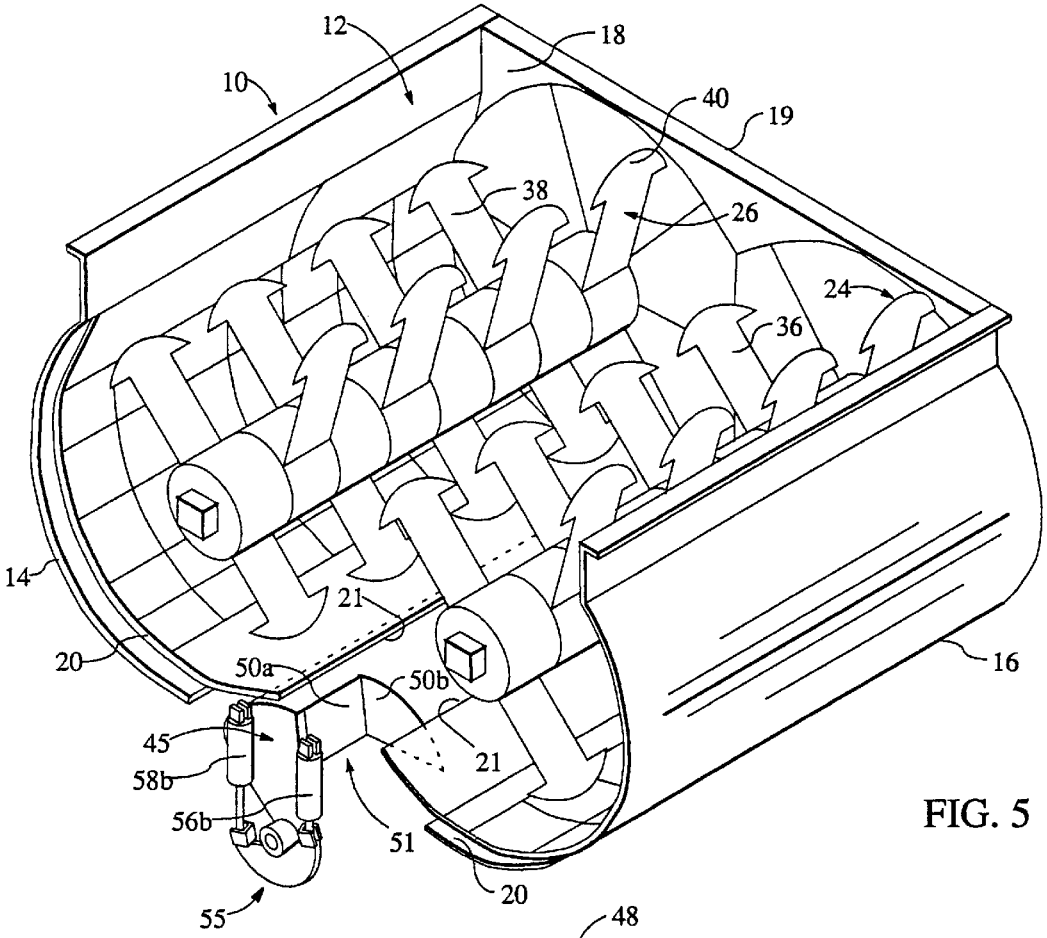
FIG. 5 is a perspective view of the twin-shaft, twin-trough mixer of the present invention illustrating the discharge door in a continuous discharge position.
Figure 5B:
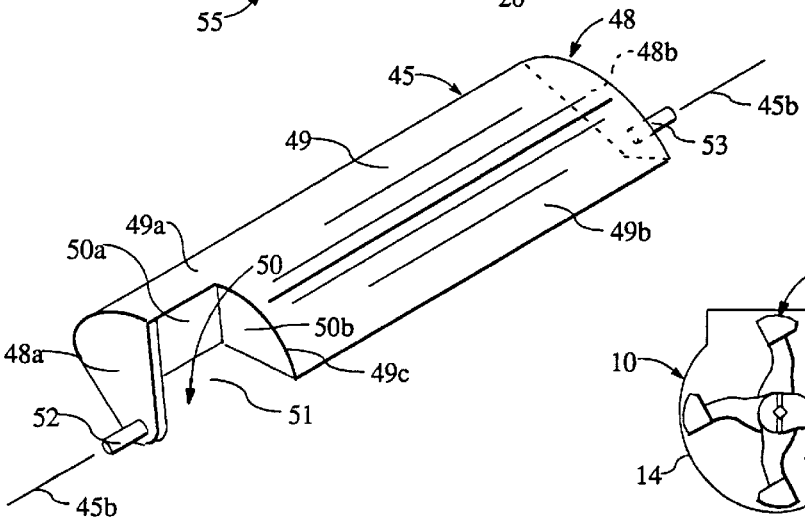
FIG. 5B is a perspective view of the discharge gate in the continuous discharge position.
Figure 5A:
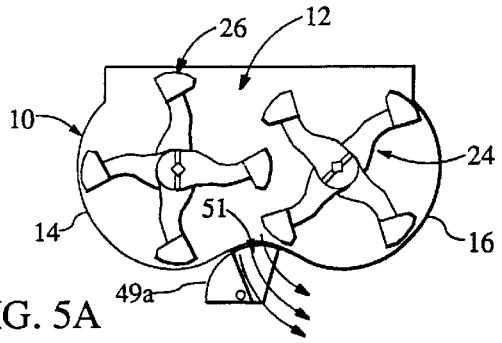
FIG. 5A is an elevational cross-sectional view illustrating the discharge door in a continuous discharge position.

The second working surface 49*b*, extending between the first and second ends of the elongated curved body and having a terminal end 49*c*, is movable into sealing relation with portions of the curved bottom walls 20 to partially close the discharge opening 22 while controlling flow of material through an open portion 51 of the discharge opening 22, as best illustrated in FIGS. 5, 5A and 5B.

Figure 4:
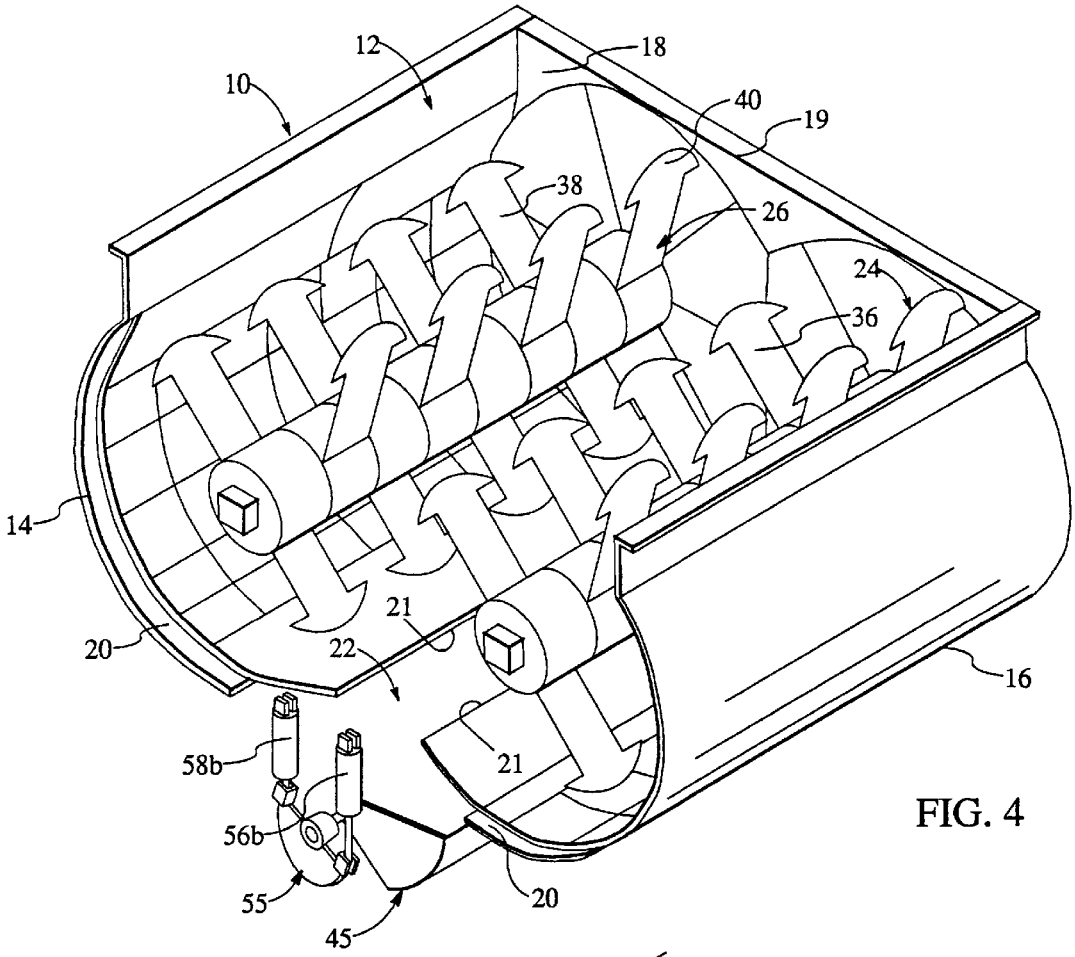
FIG. 4 is a perspective view of the twin-shaft, twin-trough mixer of the present invention illustrating the discharge door in a batch discharge position.
Figure 4B:
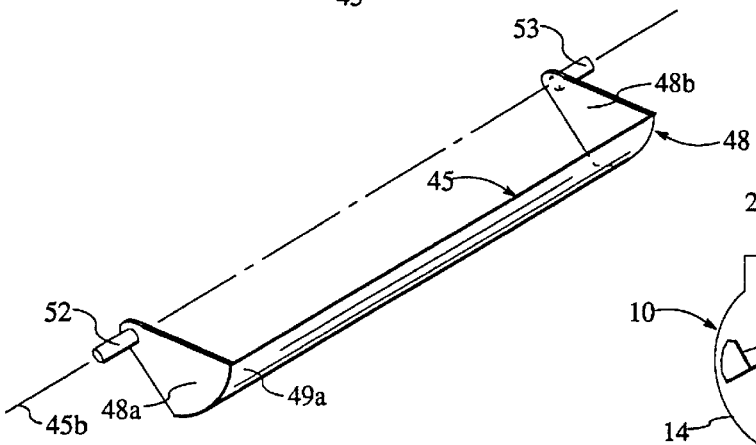
FIG. 4B is a perspective view of the discharge gate in the batch discharge position.
Figure 4A:
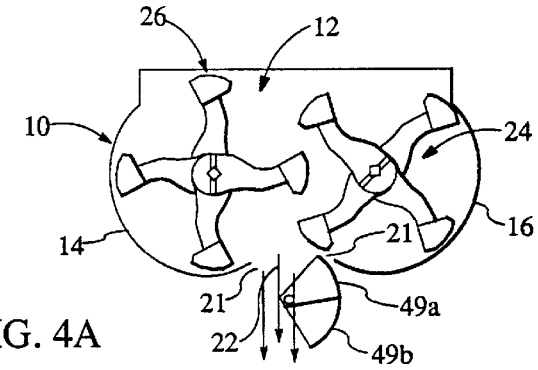
FIG. 4A is a cross-sectional view illustrating the discharge door in a batch discharge position.

An actuator, generally designated by the numeral 55, is connected to move the gate 45 between a first position, illustrated in FIGS. 1, 3, 3A and 3B, wherein said first working surface 49*a* is positioned in sealing relation with each of the curved bottom walls 20 to close the discharge opening, and a second position, illustrated in FIGS. 4, 4A and 4B, wherein said first and second working surfaces are positioned to permit flow of material through the discharge opening along substantially its entire length for operation in a batch mode or for cleaning the mixer. The actuator 55 is further connected to move the gate 45 between the first position and a third position, illustrated in FIGS. 5, 5A and 5B, wherein said first and second working surfaces 49*a* and 49*b* are positioned to permit flow of material through the discharge opening along a predetermined portion 51 of its length for operation in a continuous discharge mode.

The elongated curved body has a center of curvature and the first and second ends are rotatable about a longitudinal axis, the second working surface extending from the first end of the elongated curved body to a terminal end 49*c* spaced from the second end of the elongated curved body. The second working surface 49*b* is positionable to close a first portion of the discharge opening while controlling flow through a second portion 51 of the discharge opening.

A first shaft 52 extends from a first end wall 48*a* and a second shaft 53 extends from a second end wall 48*b*, the first and second shafts 52 and 53 having a common axis axially aligned with the center of curvature of the elongated curved body; and wherein the actuator 55 rotates gate 45 about the common axis 45*b* for moving the gate between the first, second and third positions.

The discharge door 45 comprises a segment-shaped partial cylindrical member 48 having spaced apart end walls 48*a* and 48*b* and a partial cylindrical outer wall 49 extending along a longitudinal axis 45*a* between the two end walls 48*a* and 48*b*. Outer wall 49 defines a first working surface 49*a* that extends the full length of partial cylindrical member 48 and a second working surface 49*b* that extends along a portion of the cylindrical member 48. The second working surface 49*b* terminates at a terminal end 49*c* that is spaced apart from end wall 48*a*.

An opening 50 is formed between the terminal end 49*c* and end wall 48*a* that is bounded by two partition walls 50*a* and 50*b*. The terminal end 49*c* and partition walls 50*a* and 50*b* define a continuous discharge passage 51 therebetween so that the contents of the mixer can be discharged in a continuous manner. To assure proper blending of the materials, discharge passage 51 is preferably positioned at the opposite end of the chamber from the inlet apparatus.

End walls 48*a* and 48*b* include outwardly extending shafts 52 and 53 that extend along a common axis 45*b* defining an axis of rotation for discharge door 45. Shafts 52 and 53 provide discharge door 45 with means to impart rotation to and means to support door 45. Shafts 52 and 53 are supported by the discharge door support assemblies 46*a* and 46*b*. Discharge door support assemblies 46*a* and 46*b* control the position of door 45 with respect to discharge opening 22.

The first position, which is best shown in FIGS. 1 and 3, is the fully closed position where the discharge door 45 is rotated to a position such that working surface 49*a* is aligned with the discharge opening 22 and completely covers opening 22. In this first position, no material is discharged from the mixer 10.

In the second position, which is best shown in FIG. 4, working surfaces 49*a* and 49*b* are rotated out of alignment with discharge opening 22 and permits the discharge of the mixer's contents. In this fully open position, mixer 10 operates in a batch mode and the entire contents of the mixer are discharged over a short period of time.

In the third position, which is best shown in FIG. 5, working surfaces 49*a* and 49*b* are rotated so that the continuous discharge passage 51 at one end of the second working surface 49*b* is aligned with the discharge opening 22 of the mixer 10. In this third position, mixer 10 is operating in a continuous discharge mode. In the continuous discharge mode, mixer 10 discharges its contents but at a controlled flow rate that permits new unmixed material to be introduced simultaneously through the inlet (not shown), while providing a continuous flow of mixed material through discharge opening 22.

In the preferred illustrated embodiment, as best shown in FIGS. 4 and 5, end wall 48*a* comprises a sector-shaped plate member having an approximate angle in the range of 45 degree to 60 degrees. End wall 48*b*, similarly, comprises a sector-shaped plate member having an approximate angle of in the range of 90 degree to 120 degrees. It should be understood to those having ordinary skill in the art that the size of each end plate can be varied and is influenced by the size of the discharge opening and desired curvature of working surfaces 49*a* and 49*b*. Furthermore, the end walls 48*a* and 48*b* can be the same size, with end wall 48*a* extending beyond partition wall 50*a* and, thereby, providing a splash guard. The splash guard protects the support assembly 46 from the discharged material.

A pair of discharge door support assemblies 46 are illustrated in FIGS. 1 and 2 which support shafts 52 and 53 on discharge door 45. Discharge door support assembly 46 may comprise spaced plates, an I-beam, a channel shaped member, an angle member, or any other load bearing structural member and is preferably pinned or fixed at both ends to the exterior framework 63 of the mixer 10.

Gate actuator 55, at the inlet end of mixer 10 and best illustrated in FIG. 1, comprises an actuator member 54*a* and a pair of cylinders 56*a* and 58*a*. Cylinders 56*a* and 58*a* are pinned in bushings at their rod ends 57*a* and 59*a* to actuator member 54*a* and pinned in bushings at their base ends 60*a* and 61*a* to a fixed support structure provided on the external framework 63 of mixer 10.

In the preferred embodiment illustrated in the drawings, actuator member 54*a* comprises a semi-circular rocker plate having a center of rotation 45*b* defined at the midpoint between two eccentric arm members 66*a* and 67*a*. Actuator member 54*a* includes a collar 68*a*, whose center is concentric with the axis of rotation 45*b*. Collar 68*a* is mounted on the end of discharge door shaft 52 which is fixed in collar 68 by a key so that rotation of the actuator member 54*a* imparts rotation to the discharge door 45 through shaft 52.

Similarly, discharge door actuator 55 at the discharge end of mixer 10 and illustrated in FIGS. 2 and 3, comprises an actuator member 54*b* and a pair of cylinders 56*b* and 58*b*. Cylinders 56*b* and 58*b* are pinned in bushings at their rod ends 57*b* and 59*b* to actuator member 54*b* and pinned in bushings at their base ends 60*b* and 61*b* to support structure 63. Actuator member 54*b* comprises a semi-circular rocker plate having a center of rotation defined at the midpoint between two eccentric arm members 66*b* and 67*b* and a collar 68*b*, whose center is concentric with axis 45. Collar 68*b* is mounted on shaft 53 of discharge door 45 and imparts rotation to the shaft and door through a key or other suitable connector.

The actuator members 54*a* and 54*b* impart rotation to the door 45 through keys which engage door shafts 52 and 53, respectively. Actuator members 54*a* and 54*b* are rotated about their axes of rotation by the extension of the rod of one cylinder and the simultaneous retraction of the rod of the other cylinder. As best shown in FIGS. 2 and 3, discharge door 45 is in the closed position when rods of cylinders 56*a*, 58*a*, 56*b*, and 58*b* are approximately in the mid-stroke position. FIG. 4 illustrates the door 45 in the fully open, batch mode position. In the batch mode position, rods of cylinders 58*a* and 58*b* are fully compressed and rods of cylinders 56*a* and 56*b* are fully extended thus rotating working surface 49, in a clockwise direction about axis 45*b* as viewed in FIG. 2 out of alignment with discharge opening 22. In FIG. 5, rods of cylinders 56*a* and 56*b* are fully retracted and rods of cylinders 58*a* and 58*b* are fully extended, thus rotating working surface 49 in a counter-clockwise direction about axis 45*b* as viewed in FIG. 2 so that continuous discharge passage 51 is aligned with discharge opening 22.

It should be understood that the size of the continuous discharge passage can be adjusted by varying the extension and retraction of piston rods of the cylinders. Cylinders 56*a*, 56*b*, 58*a*, and 58*b* can impart a plurality of angular positions to discharge door 45. While the closed position of door 45 preferably corresponds to rods of both cylinders in a mid-stroke position and the batch mode position preferably corresponds to rods of both cylinders 56 fully extended and cylinders 58 fully retracted, the continuous discharge position may comprise any angular position between the fully closed, where both rods of cylinders are at mid-stroke, to the position where rods of cylinders 58*a* and 58*b* are fully retracted and rods of cylinders 56*a* and 56*b* are fully extended.

As cylinders 56*a*, 56*b*, 58*a*, and 58*b* are of conventional design and are actuated by a convention control system (not shown) no further details of the cylinders and the control system are deemed necessary. However, it should be understood that cylinders 56*a*, 56*b*, 58*a*, and 58*b* may comprise hydraulic cylinders or pneumatic cylinders.

At the beginning of the mixing process, the discharge opening 22 is blocked by working surface 49*a* so that the mixer can be filled with a quantity corresponding to one batch. After filling the mixer 10 and the introduced mixture is made ready within an adjustable pre-mixing time, the operation is interrupted and the cylinders 56*a*, 56*b*, 58*a*, and 58*b* are actuated to extend and retract the respective piston rods so that discharge door 45 is rotated to one of the open positions. For the continuous mode operation, continuous discharge passage 51 is aligned with discharge opening 22. Thereupon the continuous operation is initiated by a regulated, continuous emptying of the mixture with simultaneous continuation of mixer charging. Alternatively, for the batch mode of operation, door 45 is rotated so that working surfaces 49*a* and 49*b* are out of alignment with discharge opening 22. Thereupon the batch operation is initiated by a complete emptying of the mixing chamber.

What is claimed is:

1. Improvements in mixers having by at least two troughs, formed with curved bottom walls spaced apart to provide a discharge opening between adjacent edges of the curved bottom walls such that mixed material is discharged from the mixer by controlling flow of material through the discharge opening, and mixers in each trough, the improvements comprising:

a gate formed by an elongated curved body having first and second ends and a center of curvature, said elongated curved body further having first and second juxtaposed working surfaces configured to selectively move in sealing relation to the curved bottom walls of the troughs for controlling flow of material through the discharge opening, said first working surface extending between said first and second ends of said elongated curved body and movable into sealing relation with the curved bottom walls to close the discharge opening, said second working surface extending between said first and second ends of said elongated curved body and movable into sealing relation with potions of the curved bottom walls to partially close the discharge opening while controlling flow of material through an open portion of the discharge opening;

a first shaft secured to said first end of said gate and a second shaft secured to said second end of said gate said first and second shafts having a common axis of rotation axially aligned with said center of curvature of said elongated curved body;

means movably mounting said gate adjacent the curved bottom walls of the mixer;

a rigid actuator member having an axis of rotation, a collar on said actuator member, and first and second opposed arms on said collar, one of said first and second shafts rotatably fixed in said collar; and first and second cylinders, each having a rod end and a base end, said rod end of said first cylinder mounted to said first arm, said rod end of said second cylinder mounted to said second arm, said base ends of said cylinders being secured relative to the mixer, whereby extension of one of said first and second cylinders induces rotation of said rigid actuator member and said gate about their axes of rotation in a clock-wise direction and extension of the other of said first and second cylinders induces rotation of said rigid member and said gate about their axes of rotation in a counter clock-wise direction.

2. Improvements in mixers according to claim 1, said second working surface extending from said first end of said elongated curved body to a terminal end spaced from said second end of said elongated curved body, said second working surface being positioned to close a first portion of said discharge opening while controlling flow through a second portion of said discharge opening.

3. Improvements in mixers according to claim 2, said elongated curved body having first and second end walls, and with the addition of:

said first shaft extending from said first end wall and said second shaft extending from said second end wall; and wherein said actuator rotates said gate about said common axis for moving said gate between first, second and third positions.

4. A discharge door and actuator assembly for a mixer, the mixer having a discharge opening, the discharge door and actuator assembly comprising:

a partial cylindrical body having a longitudinal extent, spaced end walls and an outer wall, said outer wall including a first working surface and a second working surface, said first working surface fully extending along said longitudinal extent, said first working surface for blocking a mixer discharge opening when said discharge door is rotated to a first closed position, said second working surface partially extending along said longituding extent amd thereby forming a continuous discharge passage through said cylindrcal body, said continuous discharge passage providing a path for continuous discharge of a mixer when said discharge door is rotaed to a second position, said first and second working surfaces being arranged to rotate to a third full open position;

a first shaft extending from said first end wall and a second shaft extending from said second end wall, said first and second shafts extending along a common axis parallel to said longitudinal extent of said cylindrical body, said common axis defining an axis of rotation for said discharge door;

an actuator having an axis of rotation, a collar concentric with said axis of rotation, and first and second opposed arms one of said first and second shafts being fixed in said collar;

first and second cylinders, each cylinder having a cylinder rod and a base, said rod of said first cylinder connected to one of said first and second arms, said second cylinder connected in the other of said first and second arms; and means for securing said bases of said cylinders to a mixer, whereby extension of said first and second cylinder rods and retraction of the other of said cylinder rods induces rotation of the actuator and door about their axes of rotation.

5. A discharge door and actuator assembly according to claim 4, wherein said first closed position corresponds to said first and second cylinder rods in a mid-stroke position, said fully open position corresponds to a fully extended position of said first cylinder rods and fully retracted position of said second cylinder rod, and said continuous discharge open position corresponds to a fully extended position of said second cylinder rod and fully retracted position of said first cylinder rod.

6. A mixer having a longitudinal extent, the mixer including a discharge opening that extends over the full longitudinal extent of the mixer, the discharge door comprising:

a gate member having a longitudinal axis, first and second end walls, a curvilinear outer wall extending between said first and second end portions along said longitudinal axis, said second portion of said curvilinear outer wall includes a terminal end at a distance from said second end wall thereby forming the continuous discharge passage between said terminal end of said second portion of said curvilinear outer wall portion and said second end wall said first and second end wall, each having a shaft extending along a common axis defining an axis of rotation for said discharge door, said outer wall having a first working portion for blocking the full longitudinal extent of the discharge opening; and a rigid actuator member having a center of rotation and means for fixing one of said shafts to said rigid actuator member for rotation therewith; and a least one cylinder having a piston rod said piston rod being connected at one end to said rigid actuator member and means on said cylinder for connecting said cylinder relative to the mixer so that extension and retraction of the rod of said cylinder imparts rotation of said rigid actuator member about its axis of rotation which in turn imparts rotation to said discharged door about its axis of rotation for rotation said gate member between a closed position wherein said first portion of said curvilinear outer wall blocks the discharge opening of the mixer, a batch discharge position wherein said curvilinear outer wall does not block the discharge opening, and a continuous discharge position wherein said second portion of said gate member and said continuous discharge passage are aligned with the discharge opening of the mixer.

7. A discharge door according to claim 6, wherein said rigid actuator member comprises a support assembly, said support assembly comprising:

a collar centered on its axis of rotation, and first and second opposed arms, one of said first and second shafts of said discharge door fixed in said collar; and first and second cylinders, each cylinder having a rod and a base end, said rod of said first cylinder mounted to one of said first and second arms, said rod of said second cylinder mounted to the other of said first and second arms means for securing said base ends of said cylinders to a mixer, whereby extension of one of said first and second cylinder rods and retraction of the other of said first and second cylinder rods induces rotation of the door about said axis of rotation.

8. A discharge door according to claim 7, wherein said closed position corresponds to said first and second cylinder rods in a mid-stroke position, said batch discharge position corresponds to a fully extended position of said first cylinder rod and fully retracted position of said second cylinder rod, and said continuous discharge position corresponds to a fully extended position of said second cylinder rod and fully retracted position of said first cylinder rod.

9. A mixer discharge gate comprising:

a partial cylindrical body having a longitudinal axis, first and second outer wall portions, and first and second end walls, said first outer wall portion extending between said first and second end walls along said longitudinal axis forming a first working surface, said second outer wall portion extending from said first end wall along said longitudinal axis to a terminal end spaced from a plane formed by said second end wall, said second outer wall portion forming a second working surface and defining a continuous discharge opening between said terminal end and said plane formed by said second end wall;

a first shaft extending from said first end wall and a second shaft extending from said second end wall, said first and second shafts extending along a common axis parallel to longitudinal axis of said cylindrical body, said common axis defining an axis of rotation of said gate; and a pair of actuators secured to one of said shafts, said pair of actuators imparting rotation to said shaft and gate about said axis of rotation.

10. A mixer discharge gate comprising:

a partial cylindrical body having a longitudinal axis, first and second outer wall portions, and first and second end walls, said first outer wall portion extending between said first and second end walls along said longitudinal axis forming a first working surface, said second outer wall portion extending from said first end wall along said longitudinal axis to a terminal end spaced from a plane formed by said second end wall, said second outer wall portion forming a second working surface and defining a continuous discharge opening between said terminal end and said plane formed by said second end wall;

a first shaft extending from said first end wall and a second shaft extending from said second end wall, said first and second shafts extending along a common axis parallel to said longitudinal axis of said cylindrical body, said common axis defining an axis of rotation of said gate;

a rigid member having an axis of rotation, a collar secured to said rigid member, and first and second opposed arms, one of side first and second shafts being fixed in said collar;

first and second cylinders, each having a rod and a base end, said rod of said first cylinder mounted to one of said first and second arms, said rod of said second cylinder mounted to the other of said first and second arms; and means for securing said base ends of cylinders relative to a mixer, whereby extension of one of said first and second cylinder rods induces rotation of said rigid member and said gate about their axes of rotation in a clock-wise direction and extension of the other of said first and second cylinder induces rotation of said rigid member and said gate about their axes of rotation in a counter clock-wise direction.

11. A mixer discharge gate according to claim 10, wherein said rigid member comprises a semi-circular plate.

* * * * *

UNITED STATES PATENT AND TRADEMARK OFFICE
CERTIFICATE OF CORRECTION

PATENT NO. : 5,810,475

DATED : September 22, 1998

INVENTOR(S) : Bobby St. Ama

It is certified that error appears in the above-identified patent and that said Letters Patent is hereby corrected as shown below:

Column 1, line 40, "entitle" should read --entitled-- and "SHAFTFORCED-FEED" should read --SHAFT FORCED-FEED--.

Column 5, line 42, "entitle" should read --entitled--.

Column 7, line 24, "degree" should read --degrees--.

Column 7, line 26 "degree" should read --degrees--.

Claim 1, line 25, after "gate" there should be a --,--.

Claim 4, line 17, "full" should read --fully--.

Claim 4, line 27, after "arms" there should be a --,--.

Claim 4, line 31, after "said" second occurrence, insert --rod of said--.

Claim 4, line 32, "in" should read --to--.

Claim 4, line 35, after "extension of" insert --one--.

Claim 6, line 12, "wall," should read -- walls --.

Claim 6, line 21, "a" first occurrence, should read --at-- and after "rod" first occurrence, there should be a --,--.

Claim 6, line 28, "rotation" second occurrence, should read --rotating--.

UNITED STATES PATENT AND TRADEMARK OFFICE
CERTIFICATE OF CORRECTION

PATENT NO. : 5,810,475

DATED : September 22, 1998

INVENTOR(S) : Bobby St. Ama

It is certified that error appears in the above-identified patent and that said Letters Patent is hereby corrected as shown below:

Claim 7, line 11, after "arms" there should be a --;--.

Claim 9, line 17, after "parallel to" insert --said--.

Claim 10, line 22, "side" should read --said--.

Claim 10, line 33, after "cylinder" insert --rods--.

Signed and Sealed this

Sixth Day of April, 1999

*Attest:*

*Attesting Officer*

Q. TODD DICKINSON

*Acting Commissioner of Patents and Trademarks*